US009972272B2

(12) United States Patent
Zhang et al.

(10) Patent No.: US 9,972,272 B2
(45) Date of Patent: May 15, 2018

(54) ARRAY SUBSTRATE AND DRIVING METHOD THEREOF, AND DISPLAY DEVICE

(71) Applicants: BOE TECHNOLOGY GROUP CO., LTD., Beijing (CN); Chengdu BOE Optoelectronics Technology Co., Ltd., Chengdu, Sichuan Province (CN)

(72) Inventors: Zihe Zhang, Beijing (CN); Bin Ji, Beijing (CN); Xiuzhu Tang, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu, Sichuan Province (CN)

( * ) Notice: Subject to any disclaimer, the term of this patent is extended or adjusted under 35 U.S.C. 154(b) by 403 days.

(21) Appl. No.: 14/540,425

(22) Filed: Nov. 13, 2014

(65) Prior Publication Data

US 2015/0379966 A1 Dec. 31, 2015

(30) Foreign Application Priority Data

Jun. 27, 2014 (CN) ..... 2014 1 0302428

(51) Int. Cl.
*G09G 3/36* (2006.01)

(52) U.S. Cl.
CPC ..... *G09G 3/3696* (2013.01); *G09G 3/3614* (2013.01); *G09G 3/3655* (2013.01); *G09G 2300/08* (2013.01); *G09G 2310/0297* (2013.01); *G09G 2330/023* (2013.01)

(58) Field of Classification Search
CPC .. G09G 3/3696; G09G 3/3614; G09G 3/3655; G09G 5/18; G09G 2300/0426; G09G 2300/08; G09G 3/36
See application file for complete search history.

(56) References Cited

U.S. PATENT DOCUMENTS

2003/0117362 A1* 6/2003 An ..... G09G 3/3688 345/98
2007/0262938 A1* 11/2007 Kim ..... G02F 1/13624 345/92
2012/0162165 A1* 6/2012 Lee ..... G09G 3/006 345/206
2016/0351142 A1* 12/2016 Ouyang ..... G09G 3/3648

* cited by examiner

*Primary Examiner* — Pegeman Karimi
(74) *Attorney, Agent, or Firm* — Nath, Goldberg & Meyer; Joshua B. Goldberg

(57) ABSTRACT

The invention discloses an array substrate and a driving method thereof, and a display device, and the array substrate includes: a common voltage generation unit, a timing control unit, a data voltage generation unit, a switch control unit and pixel units, wherein the switch control unit is connected to the common voltage generation unit, the timing control unit, the data voltage generation unit, the common voltage line and the data line, and the switch control unit is used to load a common voltage signal on the common voltage line and load a data voltage signal on the data line when a current frame of image is displayed, and load the common voltage signal on the data line and load the data voltage signal on the common voltage line when a next frame of image is displayed.

15 Claims, 4 Drawing Sheets

ARRAY SUBSTRATE AND DRIVING METHOD THEREOF, AND DISPLAY DEVICE

FIELD OF THE INVENTION

The invention relates to the field of display technology, and particularly to an array substrate and a driving method thereof, and a display device.

BACKGROUND OF THE INVENTION

The liquid crystal display is a commonly used flat panel display, and the thin film transistor liquid crystal display (abbreviated as TFT-LCD) is a mainstream product in the liquid crystal display.

The thin film transistor liquid crystal display includes a display region and a non-display region, the display region is provided with a plurality of pixel units, each pixel unit is provided with a pixel electrode, a storage capacitor, and a thin film transistor, a first terminal of the storage capacitor is connected to the data line and a source of the thin film transistor, and a second terminal of the storage capacitor is connected to a gate of the thin film transistor or a common voltage line.

The case in which the second terminal of the storage capacitor is connected to the common voltage line is taken as an example. When a gate line corresponding to a pixel unit is scanned, a data voltage signal is loaded on the first terminal of the storage capacitor through a data line, a common voltage signal is loaded on the second terminal of the storage capacitor through a common voltage line, then a voltage difference is generated between the first and second terminals of the storage capacitor, the storage capacitor is charged completely and the storage capacitor is used to maintain the voltage on the pixel electrode of the pixel unit after the scanning of the gate line of the corresponding row is finished.

Currently, the common voltage signal is generally a DC signal or an AC signal. When the common voltage signal is an AC signal, polarity reversion requirements of the liquid crystal molecules in the liquid crystal display may be met as long as the output voltage of the data voltage signal is set to be in the range of 0 to 5V; when the common voltage signal is a DC signal, only when the output voltage of the data voltage signal is set to be in the range of −5V to 5V, the polarity reversion requirements of the liquid crystal molecules in the liquid crystal display may be met.

From the above, when the common voltage signal is a DC signal, the output voltage swing of the corresponding data voltage signal is relatively large (the range of voltage variation is relatively large). If the output voltage swing of the data voltage signal is increased, the power consumed during the storage capacitor is charged or discharged is increased and the power consumption of the entire liquid crystal display panel is increased.

SUMMARY OF THE INVENTION

The invention provides an array substrate and a driving method thereof, and a display device, which can reduce the output voltage swing of the data voltage signal and decrease power consumption of the display device, while the polarity reversion of the liquid crystal molecules is achieved.

In order to achieve the above object, the present invention provides an array substrate, which includes a common voltage generation unit, a data voltage generation unit, a timing control unit, a plurality of gate lines, a plurality of data lines and a plurality of common voltage lines, a plurality of pixel units are defined by the plurality of gate lines and the plurality of data lines, each pixel unit includes a first display switch transistor and a storage capacitor, a control electrode of the first display switch transistor is connected to the gate line of a corresponding row, a first electrode of the first display switch transistor is connected to the data line of a corresponding column, a second electrode of the first display switch transistor is connected to a first terminal of the storage capacitor, and a second terminal of the storage capacitor is connected to the common voltage line of the corresponding column, wherein the array substrate further includes a plurality of switch control units, and each switch control unit is connected to the data line of the corresponding column, the common voltage line of the corresponding column, the common voltage generation unit, the data voltage generation unit and the timing control unit;

the common voltage generation unit is used to generate a common voltage signal;

the data voltage generation unit is used to generate a data voltage signal for each column of pixel units;

the timing control unit is used to generate a timing control signal; and under the control of the timing control signal, each switch control unit loads the common voltage signal on one of the common voltage line of the corresponding column and the data line of the corresponding column and loads the data voltage signal generated for the corresponding column of pixel units on the other one of the common voltage line of the corresponding column and the data line of the corresponding column when a frame of image is displayed, and loads the common voltage signal on the other one and loads the data voltage signal generated for the corresponding column of pixel units on the one when a next frame of image is displayed.

Optionally, each switch control unit includes a first control switch transistor, a second control switch transistor, a third control switch transistor and a fourth control switch transistor;

control electrodes of the first control switch transistor, the second control switch transistor, the third control switch transistor and the fourth control switch transistor are all connected to the timing control unit;

a first electrode of the first control switch transistor is connected to the data voltage generation unit, and a second electrode of the first control switch transistor is connected to the data line of the corresponding column;

a first electrode of the second control switch transistor is connected to the data voltage generation unit, and a second electrode of the second control switch transistor is connected to the common voltage line of the corresponding column;

a first electrode of the third control switch transistor is connected to the common voltage generation unit, and a second electrode of the third control switch transistor is connected to the common voltage line of the corresponding column; and a first electrode of the fourth control switch transistor is connected to the common voltage generation unit, and a second electrode of the fourth control switch transistor is connected to the data line of the corresponding column.

Optionally, the first control switch transistor, the second control switch transistor, the third control switch transistor and the fourth control switch transistor are all metal oxide semiconductor filed effect transistors.

Optionally, the timing control unit includes a timing control line, control electrodes of the first control switch transistor, the second control switch transistor, the third control switch transistor and the fourth control switch transistor are connected to the timing control line;

the first control switch transistor and the third control switch transistor are N-type transistors, and the second control switch transistor and the fourth control switch transistor are P-type transistors; or the first control switch transistor and the third control switch transistor are P-type transistors, and the second control switch transistor and the fourth control switch transistor are N-type transistors.

Optionally, the timing control unit includes two timing control lines, control electrodes of the first control switch transistor and the third control switch transistor are connected to one of the two timing control lines, control electrodes of the second control switch transistor and the fourth control switch transistor are connected to the other one of the two timing control lines, and polarities of timing control signals simultaneously loaded on the two timing control lines respectively are opposite; and wherein the first control switch transistor, the second control switch transistor, the third control switch transistor and the fourth control switch transistor are all N-type transistors, or the first control switch transistor, the second control switch transistor, the third control switch transistor and the fourth control switch transistor are all P-type transistors.

Optionally, each pixel unit further includes a second display switch transistor, a control electrode of the second display switch transistor is connected to the gate line of the corresponding row, a first electrode of the second display switch transistor is connected to the common voltage line of the corresponding column, and a second electrode of the second display switch transistor is connected to the second terminal of the storage capacitor.

Optionally, the second display switch transistor is a thin film transistor.

In order to achieve the above object, the invention further provides a display device including the above array substrate.

In order to achieve the above object, the invention further provides a driving method of an array substrate, wherein the array substrate includes a common voltage generation unit, a data voltage generation unit, a timing control unit, a plurality of gate lines, a plurality of data lines and a plurality of common voltage lines, a plurality of pixel units are defined by the plurality of gate lines and the plurality of data lines, each pixel unit includes a first display switch transistor and a storage capacitor, a control electrode of the first display switch transistor is connected to the gate line of a corresponding row, a first electrode of the first display switch transistor is connected to the data line of a corresponding column, a second electrode of the first display switch transistor is connected to a first terminal of the storage capacitor, and a second terminal of the storage capacitor is connected to the common voltage line of the corresponding column, wherein the array substrate further includes a plurality of switch control units, and each switch control unit is connected to the data line of the corresponding column, the common voltage line of the corresponding column, the common voltage generation unit, the data voltage generation unit and the timing control unit;

the common voltage generation unit is used to generate a common voltage signal;

the data voltage generation unit is used to generate a data voltage signal for each column of pixel units; and the timing control unit is used to generate a timing control signal, the driving method includes:

under the control of the timing control signal, each switch control unit loading loads the common voltage signal on one of the common voltage line of the corresponding column and the data line of the corresponding column and loads the data voltage signal generated for the corresponding column of pixel units on the other one of the common voltage line of the corresponding column and the data line of the corresponding column when a frame of image is displayed, and loads the common voltage signal on the other one and loads the data voltage signal generated for the corresponding column of pixel units on the one when a next frame of image is displayed.

In the array substrate and the driving method thereof, and the display device provided by embodiments of the invention, each switch control unit is used to switch signals loaded on the data line of the corresponding column and the common voltage line of the corresponding column so that the polarity reversion requirements of the liquid crystal molecules in the display device can be met. Moreover, the array substrate and the driving method thereof, and the display device provided by embodiments of the invention can also effectively reduce the output voltage swing of the data voltage signal so as to achieve the object of reducing power consumption of the display device.

DETAILED DESCRIPTION OF THE EMBODIMENTS

To make a person skilled in the art better understand the technical solution of the present invention, an array substrate and a driving method thereof, and a display device provided by the invention will be described in detail below in conjunction with the accompanying drawings.

Embodiment 1

Figure 1:
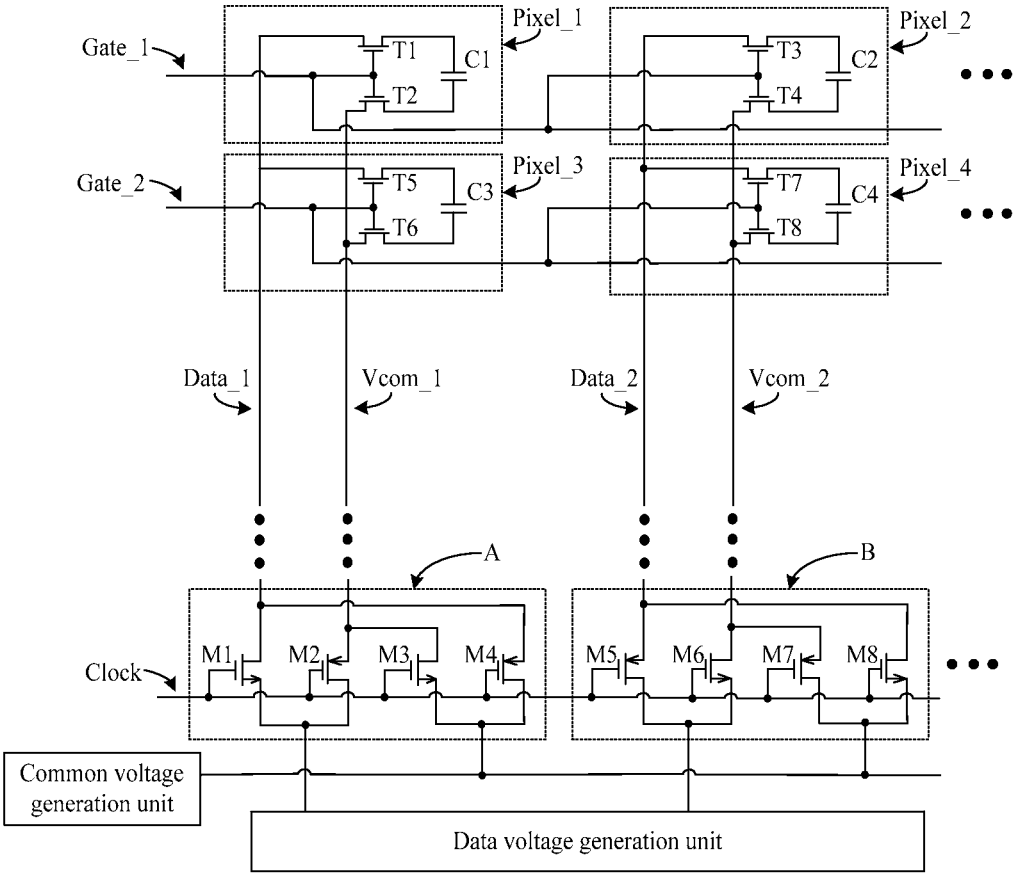
FIG. 1 is a schematic view of an array substrate provided by Embodiment 1 of the invention.
Figure 2:
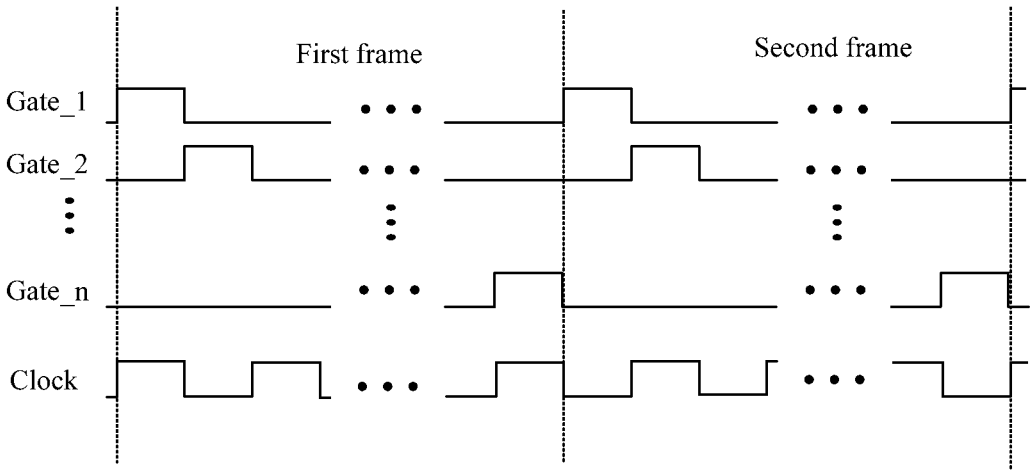
FIG. 2 is a timing diagram of various signals for driving the array substrate shown in FIG. 1.
Figure 3:
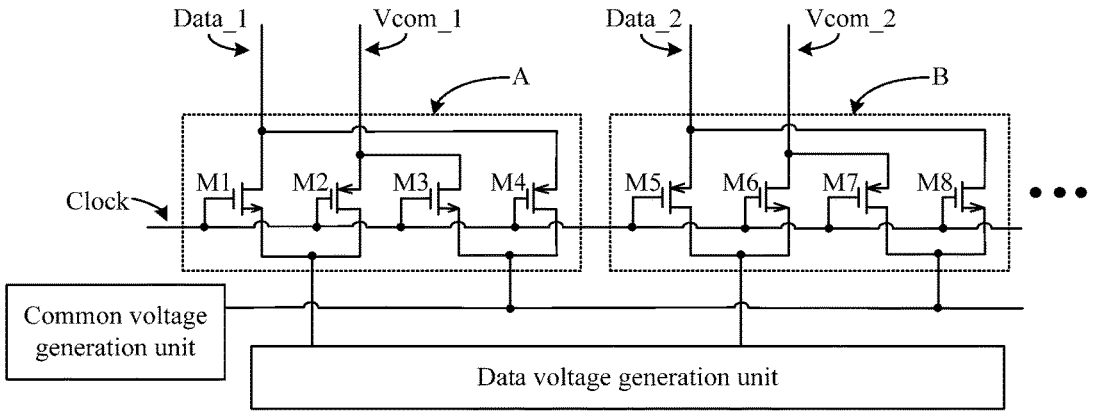
FIG. 3 is an enlarged schematic view of the switch control unit shown in FIG. 1.

FIG. 1 is a schematic view of an array substrate provided by Embodiment 1 of the invention, FIG. 2 is a timing diagram of various signals for driving the array substrate shown in FIG. 1, and FIG. 3 is an enlarged schematic view of the switch control unit shown in FIG. 1. Referring to FIGS. 1 to 3, the array substrate includes a common voltage generation unit, a data voltage generation unit, a timing control unit, a plurality of gate lines, a plurality of data lines and a plurality of common voltage lines, a plurality of pixel units are defined by the plurality of gate lines and the plurality of data lines, each pixel unit includes a first display switch transistor and a storage capacitor, a control electrode of the first display switch transistor is connected to the gate line of a corresponding row, a first electrode of the first display switch transistor is connected to the data line of a corresponding column, a second electrode of the first display switch transistor is connected to a first terminal of the storage capacitor, and a second terminal of the storage capacitor is connected to a common voltage line of a corresponding column; the array substrate further includes a plurality of switch control units, and each switch control unit is connected to the data line of the corresponding column, the common voltage line of the corresponding column, the common voltage generation unit, the data voltage generation unit and the timing control unit; wherein the common voltage generation unit is used to generate a common voltage signal; the data voltage generation unit is used to generate a data voltage signal for each column of pixel units; the timing control unit is used to generate a timing control signal; and under the control of the timing control signal, each switch control unit loads the common voltage signal on one of the common voltage line of the corresponding column and the data line of the corresponding column, and loads the data voltage signal generated for the corresponding column of pixel units on the other one of the common voltage line of the corresponding column and the data line of the corresponding column when a frame of image is displayed, and loads the common voltage signal on the other one and loads the data voltage signal generated for the corresponding column of pixel units on the one when a next frame of image is displayed.

It should be noted that, in the present embodiment, the number of the gate lines along the row direction is n, the number of the date lines along the column direction is m, the number of the common voltage lines along the column direction is m, and the number of the pixel units is n×m. FIG. 1 only exemplarily illustrates two gate lines (Gate_1 and Gate_2), two data lines (Data_1 and Data_2), two common voltage lines (Vcom_1 and Vcom_2) and four pixel units (Pixel_1, Pixel_2, Pixel_3 and Pixel_4). In the present embodiment, all pixel units of the same column correspond to one switch control unit, and FIG. 1 only exemplarity illustrate two switch control units A and B.

In the present invention, the switch control unit is used to switch two voltage signals respectively loaded on the data line and the common voltage line between two successive frames of image, so that the polarity reversion of the liquid crystal molecules in the display device is realized, while the invention can also effectively decrease the voltage swing of the data voltage signal to reduce the power consumption of the display device.

In the present embodiment, the switch control unit A is taken as an example. The switch control unit A includes: a first control switch transistor M1, a second control switch transistor M2, a third control switch transistor M3 and a fourth control switch transistor M4, wherein all of the control electrodes of the first to fourth control switch transistors M1 to M4 are connected to the timing control unit; a first electrode of the first control switch transistor M1 is connected to the data voltage generation unit, and a second electrode of the first control switch transistor M1 is connected to the data line Data_1; a first electrode of the second control switch transistor M2 is connected to the data voltage generation unit, and a second electrode of the second control switch transistor M2 is connected to the common voltage line Vcom_1; a first electrode of the third control switch transistor M3 is connected to the common voltage generation unit, and a second electrode of the third control switch transistor M3 is connected to the common voltage line Vcom_1; a first electrode of the fourth control switch transistor M4 is connected to the common voltage generation unit, and a second electrode of the fourth control switch transistor M4 is connected to the data line Data_1. In the present embodiment, the first control switch transistor M1, the second control switch transistor M2, the third control switch transistor M3 and the fourth control switch transistor M4 may be thin film transistors (abbreviated as TFT), or metal oxide semiconductor field effect transistors (abbreviated as MOSFET). Since MOSFET has high electron mobility, high charging and discharging rate, and has high switch controlling speed between ON and OFF when it is used as a switch, in the present embodiment, all of the first control switch transistor M1, the second control switch transistor M2, the third control switch transistor M3 and the fourth control switch transistor M4 are MOSFETs, to accurately and quickly switch voltage signals loaded on the data line Data_1 and the common voltage line Vcom_1. The configuration of the switch control unit B is similar to that of the switch control unit A, and the description thereof will be omitted.

It should be pointed out that, the switch control unit A (B) in the present embodiment is disposed at the wiring region of the array substrate.

In addition, a second display switch transistor is also arranged in each pixel unit of the array substrate. Taking the pixel unit Pixel_1 as an example, a control electrode of the second display switch transistor T2 is connected to the gate line Gate_1, a first electrode of the second display switch transistor T2 is connected to the common voltage line Vcom_1, and a second electrode of the second display switch transistor T2 is connected to the second terminal of the storage capacitor C1. In the present embodiment, the second display switch transistor may be a TFT or MOSFET. Preferably, the second display switch transistor is a TFT. Since both the first display switch transistor T1 and the second display switch transistor T2 are arranged in the pixel unit Pixel_1, and they are TFTs, the second display switch transistor T2 may be formed by the same manufacturing process as the first display switch transistor T1, and the first and second display switch transistors may be formed simultaneously, so as to effectively reduce the production period of the array substrate and increase the product yield.

With the driving timing shown in FIG. 2, dot inversion of the display device including the array substrate shown in FIG. 1 may be achieved. How to achieve the dot inversion of the display device will be described in detail below in conjunction with the drawings. In the present embodiment, the timing control unit includes one timing control line Clock, and control electrodes of the first control switch transistor M1 (M5), the second control switch transistor M2 (M6), the third control switch transistor M3 (M7) and the fourth control switch transistor M4 (M8) are connected to the timing control line Clock. In the switch control unit A, the first control switch transistor M1 and the third control switch transistor M3 are N-type MOSFETs, and the second control switch transistor M2 and the fourth control switch transistors M4 are P-type MOSFETs; in the switch control unit B, the first control switch transistor M5 and the third control switch transistor M7 are P-type MOSFETs, and the second control switch transistor M6 and the fourth control switch transistor M8 are N-type MOSFETs. The first display switch transistor T1 (T3, T5, T7) and the second display switch transistor T2 (T4, T6, T8) are all N-type TFTs.

When a first frame of image is displayed:

The gate line Gate_1 of the first row is first scanned, the first display switch transistor T1 and the second display switch transistor T2 of the pixel unit Pixel_1 are turned on, and the first display switch transistor T3 and the second display switch transistor T4 of the pixel unit Pixel_2 are turned on. The first display switch transistor T5 and the second display switch transistor T6 of the pixel unit Pixel_3 are turned off, and the first display switch transistor T7 and the second display switch transistor T8 of the pixel unit Pixel_4 are turned off.

At the same time, the timing control signal in the timing control line Clock is at a high level, and in the switch control unit A, the first control switch transistor M1 and the third control switch transistor M3 are turned on, and the second control switch transistor M2 and the fourth control switch transistor M4 are turned off. In the switch control unit B, the first control switch transistor M5 and the third control switch transistor M7 are turned off, and the second control switch transistor M6 and the fourth control switch transistor M8 are turned on. Accordingly, the data line Data_1 is loaded with a data voltage signal, the common voltage line Vcom_1 is loaded with a common voltage signal, the data line Data_2 is loaded with the common voltage signal and the common voltage line Vcom_2 is loaded with the data voltage signal.

Accordingly, in the pixel unit Pixel_1, the first terminal of the storage capacitor C1 is loaded with the data voltage signal, the second terminal of the storage capacitor C1 is loaded with the common voltage signal, and the voltage difference between the first and second terminals of the storage capacitor C1 is Vdata−Vvcom; in the pixel unit Pixel_2, the first terminal of the storage capacitor C2 is loaded with the common voltage signal, the second terminal of the storage capacitor C2 is loaded with the data voltage signal, and the voltage difference between the first and second terminals of the storage capacitor C2 is Vvcom−Vdata, wherein Vdata represents the output voltage of the data voltage signal, and Vvcom represents the output voltage of the common voltage signal.

It should be pointed out that, the output voltage of the data voltage signal corresponds to the display grey scale of the pixel unit, and in the present embodiment, the output voltage of the data voltage signal is in a range of 0 to 5V. In order to facilitate the description, in the present embodiment, it is assumed that when the first frame of image and the second frame of image are displayed, the output voltage of the data voltage signal is 3V and the output voltage of the common voltage signal is 0V (the feeding voltage is not considered in the present embodiment).

Thus, after the scanning of the gate line Gate_1 is completed, the voltage difference between the first and second terminals of the storage capacitor C1 in the pixel unit Pixel_1 is Vdata−Vvcom=3V−0V=3V, and the voltage difference between the first and second terminals of the storage capacitor C2 in the pixel unit Pixel_2 is Vvcom−Vdata=0V−3V=−3V.

The scanning of the gate line Gate_1 of the first row is completed, and the scanning of the gate line Gate_2 of the second row is started. At this time, the first display switch transistor T1 and the second display switch transistor T2 in the pixel unit Pixel_1 are turned off, the first display switch transistor T3 and the second display switch transistor T4 in the pixel unit Pixel_2 are turned off, the first display switch transistor T5 and the second display switch transistor T6 in the pixel unit Pixel_3 are turned on, and the first display switch transistor T7 and the second display switch transistor T8 in the pixel unit Pixel_4 are turned on.

At the same time, the timing control signal in the timing control line Clock is at a low level, and in the switch control unit A, the first control switch transistor M1 and the third control switch transistor M3 are turned off, and the second control switch transistor M2 and the fourth control switch transistor M4 are turned on. In the switch control unit B, the first control switch transistor M5 and the third control switch transistor M7 are turned on, and the second control switch transistor M6 and the fourth control switch transistor M8 are turned off. Accordingly, the data line Data_1 is loaded with the common voltage signal, the common voltage line Vcom_1 is loaded with the data voltage signal, the data line Data_2 is loaded with the data voltage signal and the common voltage line Vcom_2 is loaded with the common voltage signal.

Since both the second display switch transistor T2 in the pixel unit Pixel_1 and the second display switch transistor T4 in the pixel unit Pixel_2 are turned off at this time, the data voltage signal in the common voltage line Vcom_1 cannot be transmitted to the second terminal of the storage capacitor C1 in the pixel unit Pixel_1, and the common voltage signal in the common voltage line Vcom_2 cannot be transmitted to the second terminal of the storage capacitor C2 in the pixel unit Pixel_2, so that the influence on the respective storage capacitor in each pixel unit when voltage signals loaded on the data line and the common voltage line are switched is avoided.

Accordingly, in the pixel unit Pixel_3, the first terminal of the storage capacitor C3 is loaded with the common voltage signal, the second terminal of the storage capacitor C3 is loaded with the data voltage signal, and the voltage difference between the first and second terminals of the storage capacitor C3 is Vvcom−Vdata=0V−3V=−3V; in the pixel unit Pixel_4, the first terminal of the storage capacitor C4 is loaded with the data voltage signal, the second terminal of the storage capacitor C4 is loaded with the common voltage signal, and the voltage difference between the first and second terminals of the storage capacitor C4 is Vdata−Vvcom=3V−0V=3V.

The scanning of the gate line Gate_2 of the second row is completed, the scanning of the gate line Gate_3 of the third row (not shown in the Figures) is started, and so on, until the scanning of the gate line Gate_n of the last row (not shown in the Figures) is completed, and the display of the first frame of image is ended.

When the first frame of image is displayed, the voltage difference between the first and second terminals of the storage capacitor C1 is positive, the voltage difference between the first and second terminals of the storage capacitor C2 is negative, the voltage difference between the first and second terminals of the storage capacitor C3 is negative, and the voltage difference between the first and second terminals of the storage capacitor C4 is positive.

When a second frame of image is displayed:

The gate line Gate_1 of the first row is first scanned, the first display switch transistor T1 and the second display switch transistor T2 of the pixel unit Pixel_1 are turned on, and the first display switch transistor T3 and the second display switch transistor T4 of the pixel unit Pixel_2 are turned on. The first display switch transistor T5 and the second display switch transistor T6 of the pixel unit Pixel_3 are turned off, and the first display switch transistor T7 and the second display switch transistor T8 of the pixel unit Pixel_4 are turned off.

At the same time, the timing control signal in the timing control line Clock is at a low level, and based on the above analysis for the display of the first frame of image, at this time, the data line Data_1 is loaded with the common voltage signal, the common voltage line Vcom_1 is loaded with the data voltage signal, the data line Data_2 is loaded with the data voltage signal and the common voltage line Vcom_2 is loaded with the common voltage signal.

Accordingly, in the pixel unit Pixel_1, the first terminal of the storage capacitor C1 is loaded with the common voltage signal, the second terminal of the storage capacitor C1 is loaded with the data voltage signal, and the voltage difference between the first and second terminals of the storage capacitor C1 is Vvcom−Vdata=0−3V=−3V; in the pixel unit Pixel_2, the first terminal of the storage capacitor C2 is loaded with the data voltage signal, the second terminal of the storage capacitor C2 is loaded with the common voltage signal, and the voltage difference between the first and second terminals of the storage capacitor C2 is Vdata−Vvcom=3V−0V=3V.

The scanning of the gate line Gate_1 of the first row is completed, and the scanning of the second row of gate line Gate_2 is started. At this time, the first display switch transistor T1 and the second display switch transistor T2 in the pixel unit Pixel_1 are turned off, the first display switch transistor T3 and the second display switch transistor T4 in the pixel unit Pixel_2 are turned off, the first display switch transistor T5 and the second display switch transistor T6 in the pixel unit Pixel_3 are turned on, and the first display switch transistor T7 and the second display switch transistor T8 in the pixel unit Pixel_4 are turned on.

At the same time, the timing control signal in the timing control line Clock is at a high level, and based on the above analysis for the display of the first frame of image, at this time, the data line Data_1 is loaded with the data voltage signal, the common voltage line Vcom_1 is loaded with the common voltage signal, the data line Data_2 is loaded with the common voltage signal, and the common voltage line Vcom_2 is loaded with the data voltage signal.

Since both the second display switch transistor T2 in the pixel unit Pixel_1 and the second display switch transistor T4 in the pixel unit Pixel_2 are turned off at this time, the common voltage signal in the common voltage line Vcom_1 cannot be transmitted to the second terminal of the storage capacitor C1 in the pixel unit Pixel_1, and the data voltage signal in the common voltage line Vcom_2 cannot be transmitted to the second terminal of the storage capacitor C2 in the pixel unit Pixel_2, so that the influence on the respective storage capacitor in each pixel unit when voltage signals loaded on the data line and the common voltage line are switched is avoided.

Accordingly, in the pixel unit Pixel_3, the first terminal of the storage capacitor C3 is loaded with the data voltage signal, the second terminal of the storage capacitor C3 is loaded with the common voltage signal, and the voltage difference between the first and second terminals of the storage capacitor C3 is Vdata−Vvcom=3V−0V=3V; in the pixel unit Pixel_4, the first terminal of the storage capacitor C4 is loaded with the common voltage signal, the second terminal of the storage capacitor C4 is loaded with the data voltage signal, and the voltage difference between the first and second terminals of the storage capacitor C4 is Vvcom−Vdata=0V−3V=−3V.

The scanning of the gate line Gate_2 of the second row is completed, the scanning of the gate line Gate_3 of the third row (not shown in the Figures) is started, and so on, until the scanning of the gate line Gate_n of the last row (not shown in the Figures) is completed, and the display of the second frame of image is ended.

When the second frame of image is displayed, the voltage difference between the first and second terminals of the storage capacitor C1 is negative, the voltage difference between the first and second terminals of the storage capacitor C2 is positive, the voltage difference between the first and second terminals of the storage capacitor C3 is positive, and the voltage difference between the first and second terminals of the storage capacitor C4 is negative.

With the above processes, the dot inversion of the display device including the array substrate shown in FIG. 1 can be achieved. In addition, during the process of achieving the dot inversion, when the common voltage signal is a DC signal, the output voltage of the data voltage signal is maintained to be in the range of 0 to 5V, so as to reduce the output voltage swing of the data voltage signal and then decrease power consumption of the display device. At the same time, since only one timing control line is provided for all of the switch control units on the array substrate, the number of wirings of the array substrate can be effectively reduced and thus the area of the display region can be effectively increased.

Figure 4:
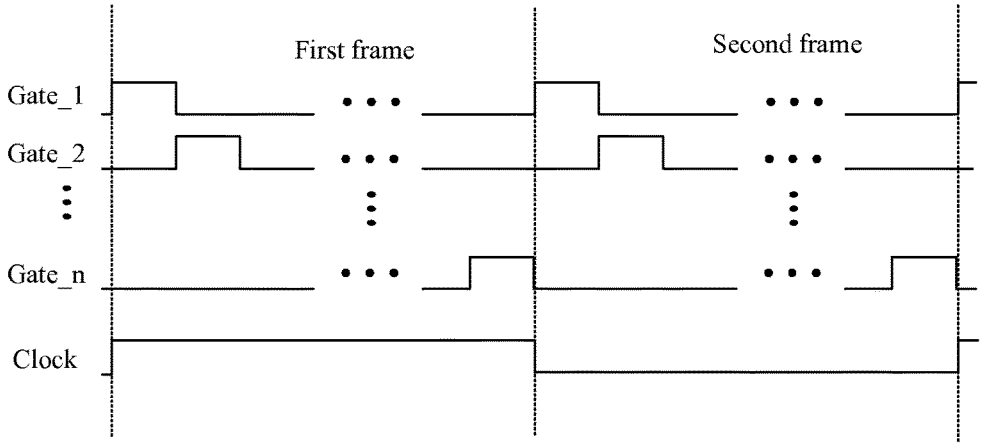
FIG. 4 is another timing diagram of various signals for driving the array substrate shown in FIG. 1.

It should be pointed out that, the display device including the array substrate shown in FIG. 1 not only can achieve the dot inversion, but also can achieve the column inversion. FIG. 4 is another timing diagram of various signals for driving the array substrate shown in FIG. 1. As shown in FIG. 4, the column inversion and the row inversion of the display device including the array substrate shown in FIG. 1 can be achieved using the driving timing sequence shown in FIG. 4. The driving timing sequence shown in FIG. 4 is different from that in FIG. 2 in that the timing control signal is maintained to be at a high level when the first frame of image is displayed, and is maintained to be at a low level when the second frame of image is displayed, that is, the level of the timing control signal is changed once every one frame.

In the case that the array substrate shown in FIG. 1 is controlled using the driving timing sequence shown in FIG. 4, when the first frame of image is displayed, the voltage difference between the first and second terminals of the storage capacitor C1 is positive, the voltage difference between the first and second terminals of the storage capacitor C2 is negative, the voltage difference between the first and second terminals of the storage capacitor C3 is positive, and the voltage difference between the first and second terminals of the storage capacitor C4 is negative; when the second frame of image is displayed, the voltage difference between the first and second terminals of the storage capacitor C1 is negative, the voltage difference between the first and second terminals of the storage capacitor C2 is positive, the voltage difference between the first and second terminals of the storage capacitor C3 is negative, and the voltage difference between the first and second terminals of the storage capacitor C4 is positive, that is, the column inversion is achieved, and the particular process thereof will not be described in detail herein.

In addition, the array substrate provided by the invention can also achieve the row inversion. It is assumed that in FIG. 1, as for the switch control unit A, the first control switch transistor M1 and the third control switch transistor M3 are N-type MOSFETs, and the second control switch transistor M2 and the fourth control switch transistor M4 are P-type MOSFETs; and as for the switch control unit B, the first control switch transistor M5 and the third control switch transistor M7 are N-type MOSFETs, and the second control switch transistor M6 and the fourth control switch transistor M8 are P-type MOSFETs, that is, the switch control unit A is the same as the switch control unit B. In the case that the driving timing sequence shown in FIG. 2 is used, when the first frame of image is displayed, the voltage difference between the first and second terminals of the storage capacitor C1 is positive, the voltage difference between the first and second terminals of the storage capacitor C2 is positive, the voltage difference between the first and second terminals of the storage capacitor C3 is negative, and the voltage difference between the first and second terminals of the storage capacitor C4 is negative; when the second frame of image is displayed, the voltage difference between the first and second terminals of the storage capacitor C1 is negative, the voltage difference between the first and second terminals of the storage capacitor C2 is negative, the voltage difference between the first and second terminals of the storage capacitor C3 is positive, and the voltage difference between the first and second terminals of the storage capacitor C4 is positive, that is, the row inversion is achieved, and the particular process thereof will not be described in detail herein.

Embodiment 1 of the invention provides an array substrate, which includes a common voltage generation unit, a timing control unit, a data voltage generation unit, a plurality of switch control units and a plurality of pixel units, wherein each switch control unit is connected to the common voltage generation unit, the timing control unit, the data voltage generation unit, the common voltage line of the corresponding column and the data line of the corresponding line, and is used to switch the voltage signals loaded on the data line and the common voltage line so that the polarity inversion of the liquid crystal molecules in the display device is achieved, and further, the array substrate provided by the invention can also effectively reduce the output voltage swing of the data voltage signal so as to reduce the power consumption of the display device.

Embodiment 2

Figure 5:
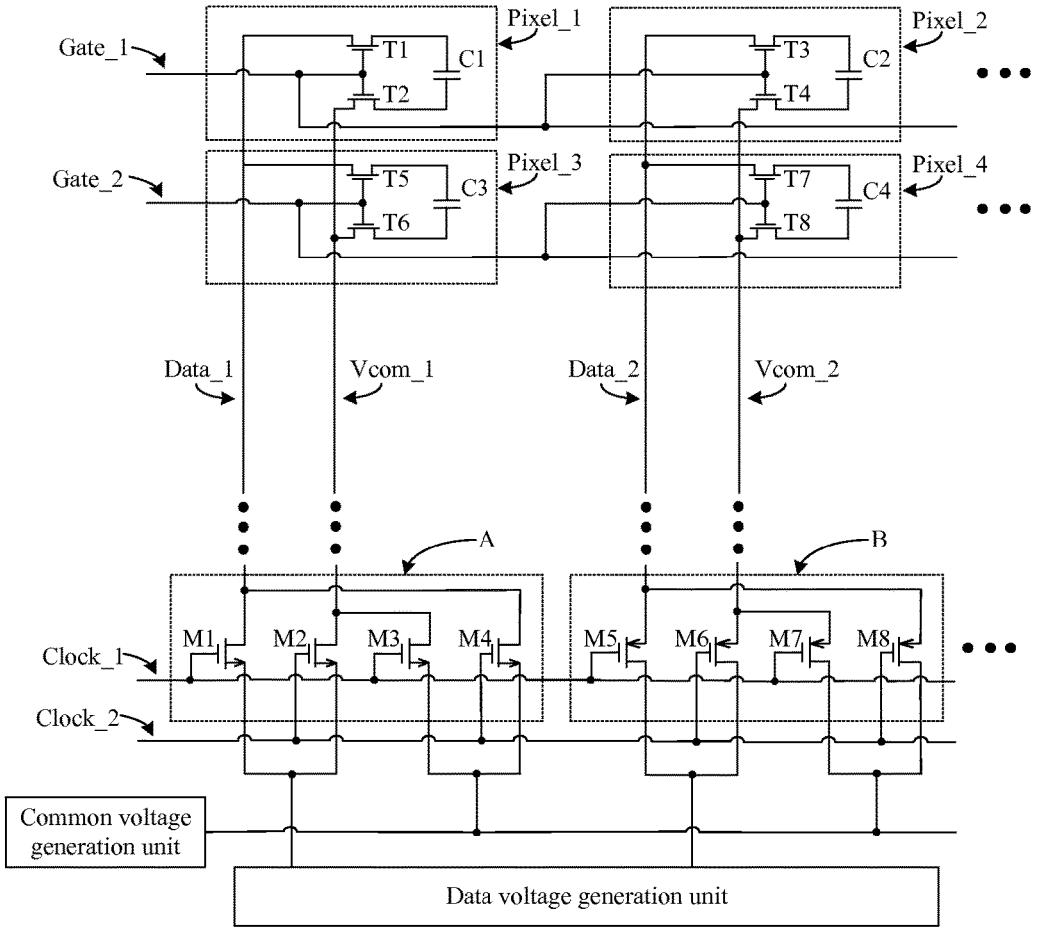
FIG. 5 is a schematic view of an array substrate provided by Embodiment 2 of the invention.
Figure 6:
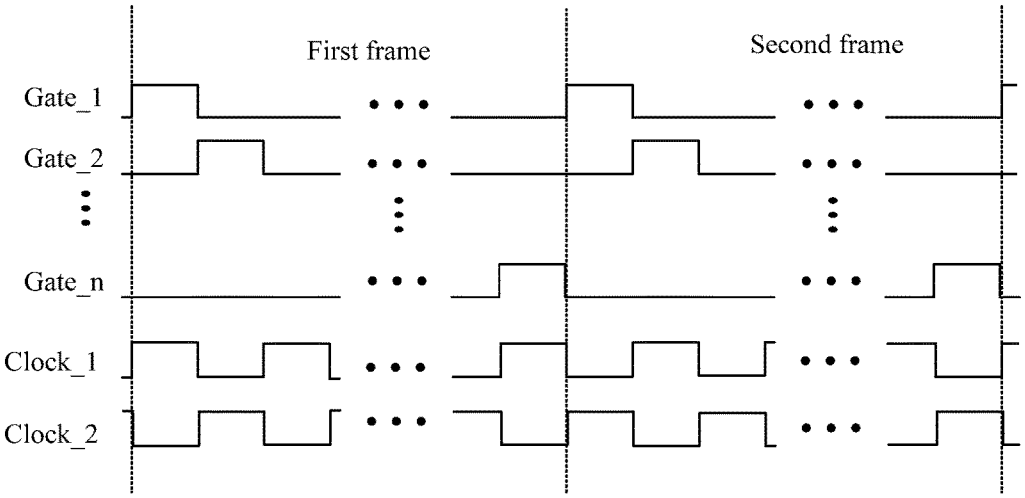
FIG. 6 is a timing diagram of various signals for driving the array substrate shown in FIG. 5.
Figure 7:
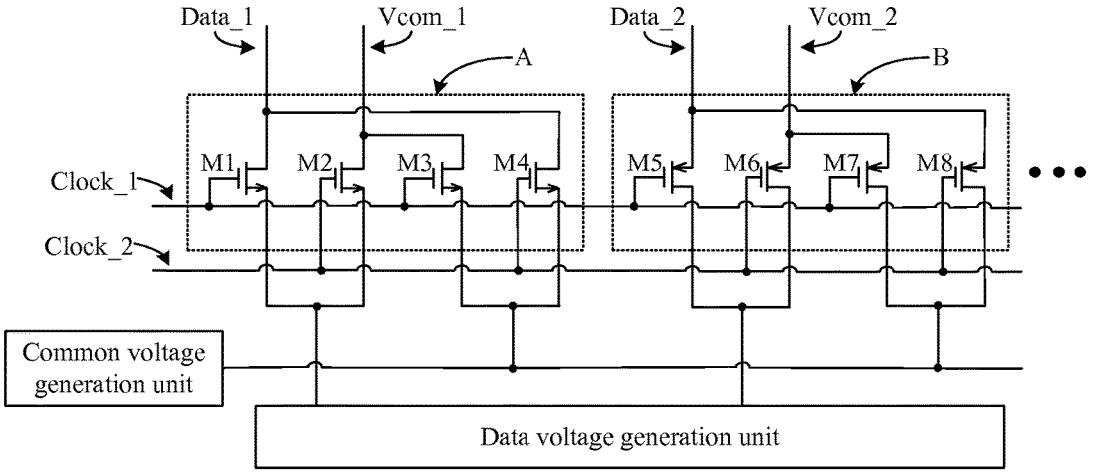
FIG. 7 is an enlarged schematic view of the switch control unit shown in FIG. 5.

FIG. 5 is a schematic view of an array substrate provided by Embodiment 2 of the invention, FIG. 6 is a timing diagram of various signals for driving the array substrate shown in FIG. 5, and FIG. 7 is an enlarged schematic view of the switch control unit shown in FIG. 5. Referring to FIGS. 5 to 7, the array substrate shown in FIG. 5 is different from that shown in FIG. 1 in that the timing control unit in the array substrate shown in FIG. 5 includes two timing control lines Clock_1 and Clock_2, control electrodes of the first control switch transistor M1 and the third control switch transistor M3 in the switch control unit A are connected to the timing control line Clock_1, and control electrodes of the second control switch transistor M2 and the fourth control switch transistor M4 in the switch control unit A are connected to the timing control line Clock_2; control electrodes of the first control switch transistor M5 and the third control switch transistor M7 in the switch control unit B are connected to the timing control line Clock_1, and control electrodes of the second control switch transistor M6 and the fourth control switch transistor M8 in the switch control unit B are connected to the timing control line Clock_2, and timing control signals simultaneously loaded on the timing control line Clock_1 and the timing control line Clock_2 have opposite polarities.

In the present embodiment, it is assumed that the first control switch transistor M1, the second control switch transistor M2, the third control switch transistor M3 and the fourth control switch transistor M4 in the switch control unit A are all N-type MOSFETs, and the first control switch transistor M5, the second control switch transistor M6, the third control switch transistor M7 and the fourth control switch transistor M8 in the switch control unit B are all P-type MOSFETs.

When a first frame of image is displayed:

The gate line Gate_1 of the first row is first scanned, the first display switch transistor T1 and the second display switch transistor T2 of the pixel unit Pixel_1 are turned on, and the first display switch transistor T3 and the second display switch transistor T4 of the pixel unit Pixel_2 are turned on. The first display switch transistor T5 and the second display switch transistor T6 of the pixel unit Pixel_3 are turned off, and the first display switch transistor T7 and the second display switch transistor T8 of the pixel unit Pixel_4 are turned off.

At the same time, the timing control signal in the timing control line Clock_1 is at a high level, and the timing control signal in the timing control line Clock_2 is at a low level. Thus, in the switch control unit A, the first control switch transistor M1 and the third control switch transistor M3 are turned on, and the second control switch transistor M2 and the fourth control switch transistor M4 are turned off. In the switch control unit B, the first control switch transistor M5 and the third control switch transistor M7 are turned off, and the second control switch transistor M6 and the fourth control switch transistor M8 are turned on. Accordingly, the data line Data_1 is loaded with a data voltage signal, the common voltage line Vcom_1 is loaded with a common voltage signal, the data line Data_2 is loaded with the common voltage signal and the common voltage line Vcom_2 is loaded with the data voltage signal.

Thus, after the scanning of the gate line Gate_1 is completed, the voltage difference between the first and second terminals of the storage capacitor C1 in the pixel unit Pixel_1 is Vdata−Vvcom=3V−0V=3V, and the voltage difference between the first and second terminals of the storage capacitor C2 in the pixel unit Pixel_2 is Vvcom−Vdata=0V−3V=−3V.

The scanning of the gate line Gate_1 of the first row is completed, and the scanning of the second row of gate line Gate_2 is started. At this time, the first display switch transistor T1 and the second display switch transistor T2 in the pixel unit Pixel_1 are turned off, the first display switch transistor T3 and the second display switch transistor T4 in the pixel unit Pixel_2 are turned off, the first display switch transistor T5 and the second display switch transistor T6 in the pixel unit Pixel_3 are turned on, and the first display switch transistor T7 and the second display switch transistor T8 in the pixel unit Pixel_4 are turned on.

At the same time, the timing control signal in the timing control line Clock_1 is at a low level, and the timing control signal in the timing control line Clock_2 is at a high level. Thus, in the switch control unit A, the first control switch transistor M1 and the third control switch transistor M3 are turned off, and the second control switch transistor M2 and the fourth control switch transistor M4 are turned on. In the switch control unit B, the first control switch transistor M5 and the third control switch transistor M7 are turned on, and the second control switch transistor M6 and the fourth control switch transistor M8 are turned off. Accordingly, the data line Data_1 is loaded with the common voltage signal, the common voltage line Vcom_1 is loaded with the data voltage signal, the data line Data_2 is loaded with the data voltage signal and the common voltage line Vcom_2 is loaded with the common voltage signal.

Thus, after the scanning of the gate line Gate_2 is completed, the voltage difference between the first and second terminals of the storage capacitor C3 in the pixel unit Pixel_3 is Vvcom−Vdata=0V−3V=−3V, and the voltage difference between the first and second terminals of the storage capacitor C4 in the pixel unit Pixel_4 is Vdata−Vvcom=3V−0V=3V.

The scanning of the gate line Gate_2 of the second row is completed, the scanning of the gate line Gate_3 of third row (not shown in the Figures) is started, and so on, until the scanning of the gate line Gate_n of the last row (not shown in the Figures) is completed, and the display of the first frame of image is ended.

When the first frame of image is displayed, the voltage difference between the first and second terminals of the storage capacitor C1 is positive, the voltage difference between the first and second terminals of the storage capacitor C2 is negative, the voltage difference between the first and second terminals of the storage capacitor C3 is negative, and the voltage difference between the first and second terminals of the storage capacitor C4 is positive.

When a second frame of image is displayed:

The gate line Gate_1 of the first row is first scanned, the first display switch transistor T1 and the second display switch transistor T2 of the pixel unit Pixel_1 are turned on, and the first display switch transistor T3 and the second display switch transistor T4 of the pixel unit Pixel_2 are turned on. The first display switch transistor T5 and the second display switch transistor T6 of the pixel unit Pixel_3 are turned off, and the first display switch transistor T7 and the second display switch transistor T8 of the pixel unit Pixel_4 are turned off.

At the same time, the timing control signal in the timing control line Clock_1 is at a low level, and the timing control signal in the timing control line Clock_2 is at a high level. Based on the above analysis for the display of the first frame of image, at this time, the data line Data_1 is loaded with the common voltage signal, the common voltage line Vcom_1 is loaded with the data voltage signal, the data line Data_2 is loaded with the data voltage signal and the common voltage line Vcom_2 is loaded with the common voltage signal.

Thus, after the scanning of the gate line Gate_2 is completed, the voltage difference between the first and second terminals of the storage capacitor C1 in the pixel unit Pixel_1 is Vvcom−Vdata=0−3V=−3V, and the voltage difference between the first and second terminals of the storage capacitor C2 in the pixel unit Pixel_2 is Vdata−Vvcom=3V−0V=3V.

The scanning of the gate line Gate_1 of the first row is completed, and the scanning of the second row of gate line Gate_2 is started. At this time, the first display switch transistor T1 and the second display switch transistor T2 in the pixel unit Pixel_1 are turned off, the first display switch transistor T3 and the second display switch transistor T4 in the pixel unit Pixel_2 are turned off, the first display switch transistor T5 and the second display switch transistor T6 in the pixel unit Pixel_3 are turned on, and the first display switch transistor T7 and the second display switch transistor T8 in the pixel unit Pixel_4 are turned on.

At the same time, the timing control signal in the timing control line Clock_1 is at a high level, and the timing control signal in the timing control line Clock_2 is at a low level. Based on the above analysis for the display of the first frame of image, at this time, the data line Data_1 is loaded with the data voltage signal, the common voltage line Vcom_1 is loaded with the common voltage signal, the data line Data_2 is loaded with the common voltage signal, and the common voltage line Vcom_2 is loaded with the data voltage signal.

Accordingly, in the pixel unit Pixel_3, the first terminal of the storage capacitor C3 is loaded with the data voltage signal, the second terminal of the storage capacitor C3 is loaded with the common voltage signal, and the voltage difference between the first and second terminals of the storage capacitor C3 is Vdata−Vvcom=3V−0V=3V; in the pixel unit Pixel_4, the first terminal of the storage capacitor C4 is loaded with the common voltage signal, the second terminal of the storage capacitor C4 is loaded with the data voltage signal, and the voltage difference between the first and second terminals of the storage capacitor C4 is Vvcom−Vdata=0V−3V=−3V.

The scanning of the gate line Gate_2 of the second row is completed, the scanning of the gate line Gate_3 of the third row (not shown in the Figures) is started, and so on, until the scanning of the gate line Gate_n of the last row (not shown in the Figures) is completed, and the display of the second frame of image is ended.

When the second frame of image is displayed, the voltage difference between the first and second terminals of the storage capacitor C1 is negative, the voltage difference between the first and second terminals of the storage capacitor C2 is positive, the voltage difference between the first and second terminals of the storage capacitor C3 is positive, and the voltage difference between the first and second terminals of the storage capacitor C4 is negative.

With the above processes, the dot inversion of the display device including the array substrate shown in FIG. 5 can be achieved. In addition, during the process of achieving the dot inversion, when the common voltage signal is a DC signal, the output voltage of the data voltage signal is maintained to be in the range of 0 to 5V, so as to reduce the output voltage swing of the data voltage signal and then decrease power consumption of the display device.

It should be appreciated by the person skilled in the art that, in a practical application, the timing control unit in the invention may include more than two timing control lines, which cooperate to achieve the control of the respective control switch transistors in the switch control unit. In addition, as known by the person skilled in the art, the types (N/P) of the respective control switch transistors in the switch control unit and the polarities of the timing control signals may be changed correspondingly, which will not further described.

Embodiment 2 of the invention provides an array substrate, which includes a common voltage generation unit, a timing control unit, a data voltage generation unit, a plurality of switch control units and a plurality of pixel units, wherein each switch control unit is connected to the common voltage generation unit, the timing control unit, the data voltage generation unit, the common voltage line of the corresponding column and the data line of the corresponding line, and is used to switch the voltage signals loaded on the data line and the common voltage line so that the polarity inversion of the liquid crystal molecules in the display device is achieved, and further, the array substrate provided by the invention can also effectively reduce the output voltage swing of the data voltage signal so as to reduce the power consumption of the display device.

Embodiment 3

The present embodiment of the invention provides a display device which includes an array substrate, wherein the array substrate may be the array substrate provided by Embodiment 1 or Embodiment 2, and the detailed description thereof may refer to the description of the above Embodiment 1 or 2 and will be omitted herein.

The display device may include an array substrate, which includes a common voltage generation unit, a timing control unit, a data voltage generation unit, a plurality of switch control units and a plurality of pixel units, wherein each switch control unit is connected to the common voltage generation unit, the timing control unit, the data voltage generation unit, the common voltage line of the corresponding column and the data line of the corresponding line, and is used to switch the voltage signals loaded on the data line and the common voltage line so that the polarity inversion of the liquid crystal molecules in the display device is achieved, and further, the array substrate provided by the invention can also effectively reduce the output voltage swing of the data voltage signal so as to reduce the power consumption of the display device.

Embodiment 4

Figure 8:
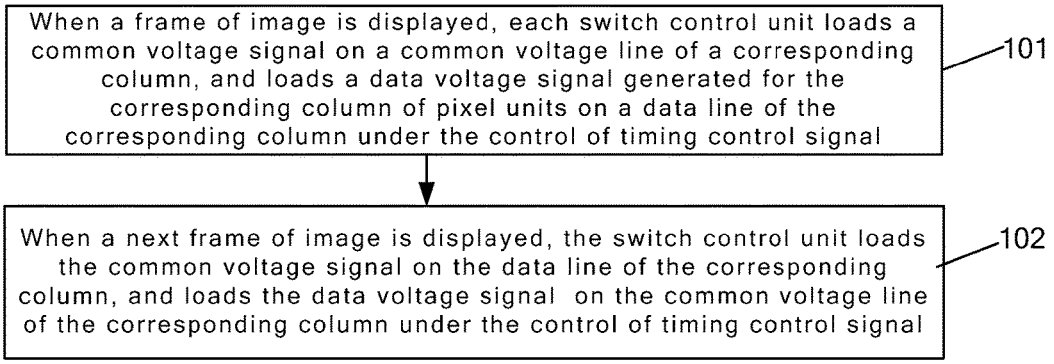
FIG. 8 is a flow chart illustrating a driving method of an array substrate provided by an embodiment of the invention.

FIG. 8 is a flow chart illustrating a driving method of an array substrate provided by Embodiment 4 of the invention. As shown in FIG. 8, the array substrate may be the array substrate provided by the above Embodiment 1 or 2, and the detailed description thereof may refer to the description of the above Embodiment 1 or 2 and will be omitted herein. The driving method includes the following Step 101 and Step 102.

Step 101: when a frame of image is displayed, under the control of the timing control signal, each switch control unit loads the common voltage signal on the common voltage line of the corresponding column, and loads the data voltage signal generated for the corresponding column of pixel units on the data line of the corresponding column.

Step 102: when a next frame of image is displayed, under the control of the timing control signal, the switch control unit loads the common voltage signal on the data line of the corresponding column, and loads the data voltage signal on the common voltage line of the corresponding column.

It should be pointed out that, the order of the above Step 101 and Step 102 may be exchanged.

By performing Step 101 and Step 102, the positive or negative property of the voltage difference of the storage capacitor in the pixel unit is alternately changed, so that the polarity inversion of the liquid crystal molecules of the pixel unit may be achieved. Based on the above principle, the array substrate can achieve the dot inversion, the row inversion and the column inversion, and the detailed description thereof may refer to the description of the above Embodiment 1 or 2 and will be omitted herein.

Embodiment 4 of the invention provides a driving method of an array substrate, in which the voltage signals loaded on the data line and the common voltage line are switched between two adjacent frames of image by the switch control unit, so that the polarity inversion of the liquid crystal molecules in the display device is achieved, and further, the driving method provided by the invention can also effectively reduce the output voltage swing of the data voltage signal so as to reduce the power consumption of the display device.

It can be understood that, the foregoing implementations are merely specific implementations adopted for illustrating the principle of the present invention, but the protection scope of the present invention is not limited thereto. Various variations and improvements could be made by the person of ordinary skill in the art without departing from the spirit and essence of the present invention, and these variations and improvements are also deemed as the protection scope of the present invention.

The invention claimed is:

1. An array substrate, including a common voltage generator, a data voltage generator, a timing controller, a plurality of gate lines, a plurality of data lines and a plurality of common voltage lines, a plurality of pixel units are defined by the plurality of gate lines and the plurality of data lines, each pixel unit includes a first display switch transistor and a storage capacitor, a control electrode of the first display switch transistor is connected to the gate line of a corresponding row, a first electrode of the first display switch transistor is connected to the data line of a corresponding column, a second electrode of the first display switch transistor is connected to a first terminal of the storage capacitor, and a second terminal of the storage capacitor is connected to the common voltage line of the corresponding column, wherein the array substrate further includes a plurality of switch control units, and each switch control unit is connected to the data line of the corresponding column, the common voltage line of the corresponding column, the common voltage generator, the data voltage generator and the timing controller;

the common voltage generator is used to generate a common voltage signal;

the data voltage generator is used to generate a data voltage signal for each column of pixel units;

the timing controller is used to generate a timing control signal;

under the control of the timing control signal, each switch control unit loads the common voltage signal on one of the common voltage line of the corresponding column and the data line of the corresponding column and loads the data voltage signal generated for the corresponding column of pixel units on the other one of the common voltage line of the corresponding column and the data line of the corresponding column when a frame of image is displayed, and loads the common voltage signal on the other one and loads the data voltage signal generated for the corresponding column of pixel units on the one when a next frame of image is displayed, and wherein the timing controller includes only one timing control line, each control unit is controlled by a same timing control signal transmitted by the one timing control line.

2. The array substrate according to claim 1, wherein each switch control unit includes a first control switch transistor, a second control switch transistor, a third control switch transistor and a fourth control switch transistor;

control electrodes of the first control switch transistor, the second control switch transistor, the third control switch transistor and the fourth control switch transistor are all connected to the timing controller;

a first electrode of the first control switch transistor is connected to the data voltage generator, and a second electrode of the first control switch transistor is connected to the data line of the corresponding column;

a first electrode of the second control switch transistor is connected to the data voltage generator, and a second electrode of the second control switch transistor is connected to the common voltage line of the corresponding column;

a first electrode of the third control switch transistor is connected to the common voltage generator, and a second electrode of the third control switch transistor is connected to the common voltage line of the corresponding column; and a first electrode of the fourth control switch transistor is connected to the common voltage generator, and a second electrode of the fourth control switch transistor is connected to the data line of the corresponding column.

3. The array substrate according to claim 2, wherein the first control switch transistor, the second control switch transistor, the third control switch transistor and the fourth control switch transistor are all metal oxide semiconductor filed effect transistors.

4. The array substrate according to claim 2, wherein control electrodes of the first control switch transistor, the second control switch transistor, the third control switch transistor and the fourth control switch transistor are connected to the timing control line;

the first control switch transistor and the third control switch transistor are N-type transistors, and the second control switch transistor and the fourth control switch transistor are P-type transistors; or the first control switch transistor and the third control switch transistor are P-type transistors, and the second control switch transistor and the fourth control switch transistor are N-type transistors.

5. The array substrate according to claim 1, wherein each pixel unit further includes a second display switch transistor, a control electrode of the second display switch transistor is connected to the gate line of the corresponding row, a first electrode of the second display switch transistor is connected to the common voltage line of the corresponding column, and a second electrode of the second display switch transistor is connected to the second terminal of the storage capacitor.

6. The array substrate according to claim 5, wherein the second display switch transistor is a thin film transistor.

7. An array substrate, including a common voltage generator, a data voltage generator, a timing controller, a plurality of gate lines, a plurality of data lines and a plurality of common voltage lines, a plurality of pixel units are defined by the plurality of gate lines and the plurality of data lines, each pixel unit includes a first display switch transistor and a storage capacitor, a control electrode of the first display switch transistor is connected to the gate line of a corresponding row, a first electrode of the first display switch transistor is connected to the data line of a corresponding column, a second electrode of the first display switch transistor is connected to a first terminal of the storage capacitor, and a second terminal of the storage capacitor is connected to the common voltage line of the corresponding column, wherein the array substrate further includes a plurality of switch control units, and each switch control unit is connected to the data line of the corresponding column, the common voltage line of the corresponding column, the common voltage generator, the data voltage generator and the timing controller;

the common voltage generator is used to generate a common voltage signal;

the data voltage generator is used to generate a data voltage signal for each column of pixel units;

the timing controller is used to generate a timing control signal; and under the control of the timing control signal, each switch control unit loads the common voltage signal on one of the common voltage line of the corresponding column and the data line of the corresponding column and loads the data voltage signal generated for the corresponding column of pixel units on the other one of the common voltage line of the corresponding column and the data line of the corresponding column when a frame of image is displayed, and loads the common voltage signal on the other one and loads the data voltage signal generated for the corresponding column of pixel units on the one when a next frame of image is displayed, wherein each switch control unit includes a first control switch transistor, a second control switch transistor, a third control switch transistor and a fourth control switch transistor;

control electrodes of the first control switch transistor, the second control switch transistor, the third control switch transistor and the fourth control switch transistor are all connected to the timing controller;

a first electrode of the first control switch transistor is connected to the data voltage generator, and a second electrode of the first control switch transistor is connected to the data line of the corresponding column;

a first electrode of the second control switch transistor is connected to the data voltage generator, and a second electrode of the second control switch transistor is connected to the common voltage line of the corresponding column;

a first electrode of the third control switch transistor is connected to the common voltage generator, and a second electrode of the third control switch transistor is connected to the common voltage line of the corresponding column; and a first electrode of the fourth control switch transistor is connected to the common voltage generator, and a second electrode of the fourth control switch transistor is connected to the data line of the corresponding column, wherein the timing controller includes two timing control lines, control electrodes of the first control switch transistor and the third control switch transistor are connected to one of the two timing control lines, control electrodes of the second control switch transistor and the fourth control switch transistor are connected to the other one of the two timing control lines, and polarities of timing control signals simultaneously loaded on the two timing control lines respectively are opposite;

wherein the first control switch transistor, the second control switch transistor, the third control switch transistor and the fourth control switch transistor are all N-type transistors, or the first control switch transistor, the second control switch transistor, the third control switch transistor and the fourth control switch transistor are all P-type transistors, and wherein for two adjacent columns of switch control units, the first control switch transistor, the second control switch transistors, the third control switch transistor and the fourth control switch transistor included in one switch control unit are all P-type transistors, and the first control switch transistor, the second control switch transistor, the third control switch transistor and the fourth control switch transistor included in the other switch control unit are all N-type transistors.

8. A display device, including an array substrate, the array substrate includes a common voltage generator, a data voltage generator, a timing controller, a plurality of gate lines, a plurality of data lines and a plurality of common voltage lines, a plurality of pixel units are defined by the plurality of gate lines and the plurality of data lines, each pixel unit includes a first display switch transistor and a storage capacitor, a control electrode of the first display switch transistor is connected to the gate line of a corresponding row, a first electrode of the first display switch transistor is connected to the data line of a corresponding column, a second electrode of the first display switch transistor is connected to a first terminal of the storage capacitor, and a second terminal of the storage capacitor is connected to the common voltage line of the corresponding column, wherein the array substrate further includes a plurality of switch control units, and each switch control unit is connected to the data line of the corresponding column, the common voltage line of the corresponding column, the common voltage generator, the data voltage generator and the timing controller;

the common voltage generator is used to generate a common voltage signal;

the data voltage generator is used to generate a data voltage signal for each column of pixel units;

the timing controller is used to generate a timing control signal;

under the control of the timing control signal, each switch control unit loads the common voltage signal on one of the common voltage line of the corresponding column and the data line of the corresponding column and loads the data voltage signal generated for the corresponding column of pixel units on the other one of the common voltage line of the corresponding column and the data line of the corresponding column when a frame of image is displayed, and loads the common voltage signal on the other one and loads the data voltage signal generated for the corresponding column of pixel units on the one when a next frame of image is displayed, and wherein the timing controller includes only one timing control line, each switch control unit is controlled by a same timing control signal transmitted by the one timing control line.

9. The display device according to claim 8, wherein each switch control unit includes a first control switch transistor, a second control switch transistor, a third control switch transistor and a fourth control switch transistor;

control electrodes of the first control switch transistor, the second control switch transistor, the third control switch transistor and the fourth control switch transistor are all connected to the timing controller;

a first electrode of the first control switch transistor is connected to the data voltage generator, and a second electrode of the first control switch transistor is connected to the data line of the corresponding column;

a first electrode of the second control switch transistor is connected to the data voltage generator, and a second electrode of the second control switch transistor is connected to the common voltage line of the corresponding column;

a first electrode of the third control switch transistor is connected to the common voltage generator, and a second electrode of the third control switch transistor is connected to the common voltage line of the corresponding column; and a first electrode of the fourth control switch transistor is connected to the common voltage generator, and a second electrode of the fourth control switch transistor is connected to the data line of the corresponding column.

10. The display device according to claim 9, wherein the first control switch transistor, the second control switch transistor, the third control switch transistor and the fourth control switch transistor are all metal oxide semiconductor filed effect transistors.

11. The display device according to claim 9, wherein control electrodes of the first control switch transistor, the second control switch transistor, the third control switch transistor and the fourth control switch transistor are connected to the timing control line;

the first control switch transistor and the third control switch transistor are N-type transistors, and the second control switch transistor and the fourth control switch transistor are P-type transistors; or the first control switch transistor and the third control switch transistor are P-type transistors, and the second control switch transistor and the fourth control switch transistor are N-type transistor.

12. The display device according to claim 8, wherein each pixel unit further includes a second display switch transistor, a control electrode of the second display switch transistor is connected to the gate line of the corresponding row, a first electrode of the second display switch transistor is connected to the common voltage line of the corresponding column, and a second electrode of the second display switch transistor is connected to the second terminal of the storage capacitor.

13. The display device according to claim 12, wherein the second display switch transistor is a thin film transistor.

14. A display device, including an array substrate, the array substrate includes a common voltage generator, a data voltage generator, a timing controller, a plurality of gate lines, a plurality of data lines and a plurality of common voltage lines, a plurality of pixel units are defined by the plurality of gate lines and the plurality of data lines, each pixel unit includes a first display switch transistor and a storage capacitor, a control electrode of the first display switch transistor is connected to the gate line of a corresponding row, a first electrode of the first display switch transistor is connected to the data line of a corresponding column, a second electrode of the first display switch transistor is connected to a first terminal of the storage capacitor, and a second terminal of the storage capacitor is connected to the common voltage line of the corresponding column, wherein the array substrate further includes a plurality of switch control units, and each switch control unit is connected to the data line of the corresponding column, the common voltage line of the corresponding column, the common voltage generator, the data voltage generator and the timing controller;

the common voltage generator is used to generate a common voltage signal;

the data voltage generator is used to generate a data voltage signal for each column of pixel units;

the timing controller is used to generate a timing control signal; and under the control of the timing control signal, each switch control unit loads the common voltage signal on one of the common voltage line of the corresponding column and the data line of the corresponding column and loads the data voltage signal generated for the corresponding column of pixel units on the other one of the common voltage line of the corresponding column and the data line of the corresponding column when a frame of image is displayed, and loads the common voltage signal on the other one and loads the data voltage signal generated for the corresponding column of pixel units on the one when a next frame of image is displayed, wherein each switch control unit includes a first control switch transistor, a second control switch transistor, a third control switch transistor and a fourth control switch transistor;

control electrodes of the first control switch transistor, the second control switch transistor, the third control switch transistor and the fourth control switch transistor are all connected to the timing controller;

a first electrode of the first control switch transistor is connected to the data voltage generator, and a second electrode of the first control switch transistor is connected to the data line of the corresponding column;

a first electrode of the second control switch transistor is connected to the data voltage generator, and a second electrode of the second control switch transistor is connected to the common voltage line of the corresponding column;

a first electrode of the third control switch transistor is connected to the common voltage generator, and a second electrode of the third control switch transistor is connected to the common voltage line of the corresponding column; and a first electrode of the fourth control switch transistor is connected to the common voltage generator, and a second electrode of the fourth control switch transistor is connected to the data line of the corresponding column, wherein the timing controller includes two timing control lines, control electrodes of the first control switch transistor and the third control switch transistor are connected to one of the two timing control lines, control electrodes of the second control switch transistor and the fourth control switch transistor are connected to the other one of the two timing control lines, and polarities of timing control signals simultaneously loaded on the two timing control lines respectively are opposite;

wherein the first control switch transistor, the second control switch transistor, the third control switch transistor and the fourth control switch transistor are all N-type transistors, or the first control switch transistor, the second control switch transistor, the third control switch transistor and the fourth control switch transistor are all P-type transistors, and wherein for two adjacent columns of switch control units, the first control switch transistor, the second control switch transistor, the third control switch transistor and the fourth control switch transistor included in one switch control unit are all P-type transistors, and the first control switch transistor, the second control switch transistor, third control switch transistor and the fourth control switch transistor included in the other switch control unit all N-type transistors.

15. A driving method of an array substrate, wherein the array substrate includes a common voltage generator, a data voltage generator, a timing controller, a plurality of gate lines, a plurality of data lines and a plurality of common voltage lines, a plurality of pixel units are defined by the plurality of gate lines and the plurality of data lines, each pixel unit includes a first display switch transistor and a storage capacitor, a control electrode of the first display switch transistor is connected to the gate line of a corresponding row, a first electrode of the first display switch transistor is connected to the data line of a corresponding column, a second electrode of the first display switch transistor is connected to a first terminal of the storage capacitor, and a second terminal of the storage capacitor is connected to the common voltage line of the corresponding column, wherein the array substrate further includes a plurality of switch control units, and each switch control unit is connected to the data line of the corresponding column, the common voltage line of the corresponding column, the common voltage generator, the data voltage generator and the timing controller;

the common voltage generator is used to generate a common voltage signal;

the data voltage generator is used to generate a data voltage signal for each column of pixel units; and the timing controller is used to generate a timing control signal, wherein the timing controller includes only one timing control line, each switch control unit is controlled by a same control signal transmitted by the one timing control line, the driving method includes:

under the control of the timing control signal, each switch control unit loads the common voltage signal on one of the common voltage line of the corresponding column and the data line of the corresponding column and loads the data voltage signal generated for the corresponding column of pixel units on the other one of the common voltage line of the corresponding column and the data line of the corresponding column when a frame of image is displayed, and loads the common voltage signal on the other one and loads the data voltage signal generated for the corresponding column of pixel units on the one when a next frame of image is displayed.

* * * * *